US005473821A

United States Patent [19]

DiMarco

[11] Patent Number: 5,473,821

[45] Date of Patent: Dec. 12, 1995

[54] PARALLELOGRAM DEVICE FOR SETTING MITERING SAWS

[76] Inventor: John DiMarco, 4925 Cross Bayou Blvd., New Port Richey, Fla. 34652

[21] Appl. No.: 38,271

[22] Filed: Mar. 29, 1993

[51] Int. Cl.[6] ..... B43L 7/10; B26D 7/01

[52] U.S. Cl. ..... 33/456; 33/534; 33/640; 83/471.3; 83/522.17

[58] Field of Search ..... 33/640, 641, 628, 33/452, 454, 455, 456, 465, 471, 1 N, 1 F, 1 AP, 534, 536, 538, 535; 83/471.3, 467.1, 468, 468.3, 477.2, 522.25, 522.17

[56] References Cited

U.S. PATENT DOCUMENTS

| | | | |
|---|---|---|---|
| 361,243 | 4/1887 | Struble | 33/455 |
| 1,660,578 | 2/1928 | Reppell | 33/455 |
| 2,222,853 | 11/1940 | Neurohr | 33/1 N |
| 3,562,919 | 2/1971 | Green | 33/346 |
| 4,002,329 | 1/1977 | Petrowski | 83/468.3 |
| 4,328,728 | 5/1982 | Ferdinand | 83/471.3 |
| 4,464,962 | 8/1984 | Myhre | 83/477.2 |
| 4,527,341 | 7/1985 | Schon | 33/461 |
| 4,881,437 | 11/1989 | Macksoud | 83/477.2 |
| 5,220,857 | 6/1993 | Freeburger | 83/471.3 |

FOREIGN PATENT DOCUMENTS

| | | | |
|---|---|---|---|
| 242894 | 11/1946 | Switzerland | 33/455 |

*Primary Examiner*—Thomas B. Will

*Attorney, Agent, or Firm*—Stanley M. Miller

[57] ABSTRACT

A parallelogram tool for measuring exterior and interior angles is used in conjunction with a miter saw having a pair of pivotally mounted guide blocks. The tool is made of six link members that are pivotally interconnected to one another. One of the pivotal connections may be tightened to lock the tool into position after a measurement has been made, and at least one pivotal connector extends below the plane of the tool. The locked tool is then transferred to the flat plate of a miter saw having a pair of arcuate slots formed in it in bilateral relation to one another and having a central diametrically extending slot. The central slot receives the pivotal connector that extends below the plane of the tool. The arcuate slots guide a pair of pivotally mounted guide blocks which are placed into abutting relation to the measuring arms of the tool and then locked into position. The tool is then removed and items to have a miter cut formed in them are placed against the guide blocks. A miter saw then performs the cuts.

4 Claims, 9 Drawing Sheets

PARALLELOGRAM DEVICE FOR SETTING MITERING SAWS

BACKGROUND OF THE INVENTION

1. Field of the Invention

This invention relates, generally, to mitering tools. More particularly, it relates to improved means for measuring and sawing miter cuts.

2. Description of the Prior Art

The arts of carpentry, metal working, and related fields often require the craftsman to measure existing exterior and interior angles so that boards, pipes, and the like can be cut to the same angles. After a measurement has been taken, a mitering saw is used to duplicate said angles.

The process is problematic when walls, pipes, or the like converge at angles other than ninety degrees, or where walls, for example, converge at differing angles along their respective extents. For example, a pair of walls may converge at eighty eight and one half degrees at a ceiling, ninety and one third degrees midway between ceiling and floor, and ninety one and two thirds degrees at the floor. These varying angles must be accurately and quickly measured, and the measurement must then be accurately and quickly transferred to a mitering saw. Accordingly, several inventors have developed devices for measuring such angles, and for transferring the measured angles to a mitering saw so that said angles can be duplicated.

For example, U.S. Pat. No. 678,005 to Myers discloses an elongate arm having a longitudinally extending slot formed therein, and a pivot member is slidably disposed within said slot and slidable along the extent thereof. A pair of rules are pivotally mounted to the leading end of the elongate arm, and a pair of pivotally connected rods interconnect the rules and the pivot member. Thus, as the angle between the rules is changed, the pivot member slides along its slot; when a measurement is to be taken, the rules are placed against the walls the angle formed by which is to be measured, and the pivot member is locked into position. The tool is then transferred to the workpiece and the measurement is transferred thereto. Thus, the angle defined by the walls will be accurately captured, but error may be introduced when the measurement is transferred to the workpiece. More particularly, the measurement is transferred by marking the board to be cut with a pencil, and then the cut must be made along the pencil line. The pencil line itself may not accurately reflect the true position of the rules, and the cut along said line may introduce still further error because the operator of the miter saw must visually guide the saw along the pencil line.

Another device, quite similar in structure and operation to the Myers device, and subject to the same limitations, is disclosed in U.S. Pat. No. 963,274 to Bundy.

U.S. Pat. No. 3,844,043 to Gustafson also discloses a tool for gauging either internal or external angles, and transferring the angle to building material; the structure and operation thereof is very similar to that of the Myers tool. A slide means is slidable along the extent of a slide arm, lockable at any position along the extent thereof, and a pair of gauge arms are pivotally connected to the leading end of said slide arm. A pair of link members interconnect the slide arm and the gauge arms, and all of the members are connected to one another at pivot points. Thus, when the gauge arms are employed to measure an exterior angle, the slide member slides forwardly along the slide arm, and is locked into place when the gauge arms overlie the walls forming the exterior angle. When an interior angle is gauged, the slide member slides in an opposite direction, and the links pull the gauge arms into a swept wing configuration. This design has two noteworthy drawbacks; first, the link members and gauge arms must be coplanar, so the slide arm must be disposed at a different angle. Since the slide member must engage both the slide arm and the link members, the stress introduced into the device by the divergence of the link arms and the slide arm may cause jamming. Secondly, no suggestion is made as to how to transfer the measured angle to a mitering saw. Instead, the suggestion is made that the measurement be transferred directly to a building material. The mitering saw is therefore set to cut along the line transferred to the building material, and said setting may differ from the actual measured angle.

A device that overcomes both of those problems is disclosed in U.S. Pat. No. 3,709,266 to Fusco. However, that device has limitations not found in the Myers and Gustafson devices. To eliminate the problem of transferring a measurement from a measuring tool to a workpiece, the Fusco measurement tool incorporates the structure of a miter saw holder. Instead of a slide member slidably mounted to a slide arm, the slide arm itself is displaced. More particularly, the slide arm is carried on an elongate screw, and longitudinal displacement of the screw and hence of the slide arm is accomplished by rotation of a crank handle that effects simultaneous and corresponding rotation of the screw. The gauge arms are pivotally mounted to the leading end of the slide arm and the mechanism, accordingly, operates much like the Gustafson device. Although the jamming and transfer problems are eliminated, the bulk of the Fusco device, since it incorporates the miter saw holder, is considerable. Moreover, its mechanical complexity ensures that its price would easily exceed that of the Gustafson device.

A device very reminiscent of the Myers and Gustafson devices is shown in U.S. Pat. No. 4,527,341 to Schon. Like Myers and Gustafson, it is a mechanically simple parallelogram device for measuring angles. Thus, it requires the craftsman to transfer the measured angle to the workpiece, and to visually guide the mitering saw along a pencil line.

U.S. Pat. No. 5,117,560 to Nevins discloses a full circle protractor for measuring angles. It enables a craftsman to set the miter angle setting of a miter saw, and thus overcomes the limitations of those devices that require the craftsman to transfer the measurement to the workpiece with a pencil and to made a cut along the pencil line. However, the individual must still read the angle setting from the device, and then set the meter saw to that angle. Thus, the actual angle is not transferred directly to the saw; error may be introduced when the angle is read and when the angle setting is applied to the saw.

What is needed, then, is a device that eliminates the step of transferring a measured angle to a workpiece by means of a pencil or the like and the step of requiring a craftsman to cut carefully along said angle. A device is also needed that eliminates the step of reading a miter angle setting from a tool and setting the miter saw at such setting. However, it is clear from the above review of the art that, at the time the present invention was made, it would not have been obvious to those of ordinary skill in this art how to build a tool capable of performing this feat.

SUMMARY OF THE INVENTION

The present invention provides a tool for measuring an exterior or interior angle, and further provides an improved mitering saw having movably mounted guide blocks the respective positions of which are set directly by the tool so that the measurement is transferred directly from the tool to the saw. This eliminates the need to transfer the measurement to the workpiece and further eliminates the need to rely upon visually-guided manual dexterity to cut along a mark transferred to said workpiece. It also eliminates any need to read an angle from a measuring tool and to set a miter saw at that angle. Thus, the invention eliminates all of the common sources of error in preparing miter cuts.

The novel measuring tool has a parallelogram structure. A first pair of elongate link members are pivotally secured to one another, about mid-length thereof, a first link member being disposed in overlying relation to a second link member. The pivotal connection between the link members is made by a first pivot pin that extends below the plane defined by the tool. A third link member of intermediate extent has a proximal end thereof pivotally secured to the distal free end of the second link member, and a fourth link member of intermediate extent has a proximal end pivotally secured to the distal free end of the first link member. The respective distal free ends of the third and fourth link members are pivotally secured to one another so that the first and third link members remain in parallel relation to one another throughout the full range of motion of the tool, and so that the second and fourth link members remain in parallel relation to one another throughout said full range. The pivotal connection between the third and fourth link members is made by a second pivot pin that extends below the plane of the tool. A fifth and a sixth link member of truncate extent have their respective proximal ends pivotally secured to the second and first link members, respectively, and the distal free ends of said fifth and sixth link members are pivotally secured to one another. Thus, the fifth link member remains parallel to the first and third link members throughout the range of motion of the tool, and the sixth link member remains parallel to the second and fourth link members throughout said range. The pivotal connection between the fifth and sixth link members is made by a third pivot means that extends below the plane of the tool.

Thus, exterior angles are measured by placing the free ends of the first and second link members in abutting relation to the exterior angle to be measured, and interior angles are measured by placing the third and fourth link members in abutting relation to the interior angle to be measured. A wing nut is provided to lock the link members into position after a measurement has been taken.

The novel miter saw includes a flat plate upon which the boards or other workpieces to be cut are positioned; the top surface of said flat plate performs the function of supporting the tool when the measurement taken by the tool is transferred to the saw and performs the function of supporting the workpiece to be cut when the measurement has been transferred and the tool has been removed from the saw.

A diametrically-extending central slot, of straight configuration, is formed in said flat plate. A pair of arcuate slots are also formed in the flat plate, there being one arcuate slot on each side of the central slot and said arcuate slots exhibiting bilateral symmetry with respect to said central slot. A pair of guide blocks, against which the boards, pipes, or other items are placed for alignment purposes when the miter cuts are to be made, are mounted for pivotal movement relative to the top surface of said flat plate along the extent of their respective arcuate slots. An elongate bolt or other pin means extends through each guide block and into its associated arcuate slot to key each guide block to its associated slot, and a pivot pin pivotally secures the radially innermost end of each guide block to said flat plate. Thus, each guide block may be positioned at any angle relative to said flat plate top surface by pivoting it about its associated pivot pin.

After the novel parallelogram tool has been used to take a measurement, a wing nut associated with the pin means that keys each guide block to its associated arcuate slot is loosened to enable pivoting of the guide blocks. The tool is then placed atop said flat plate; where an exterior angle has been measured, the respective parts of the first or third pivot pins, or both, that extend below the plane of the tool are placed into the central slot to align the tool. The guide blocks are placed into abutting relation against the link members of the tool that are disposed at the measured angle and the guide blocks are then secured into position by the tightening of a wing nut or other suitable means associated with the bolt or other pin means that extends through each guide block and its associated arcuate slot. The tool is then removed and the items to be cut are placed against said guide blocks; the miter saw then cuts each item and the desired angle is formed.

In a second embodiment, the guide blocks are interconnected to one another so that the instantaneous position of either guide block is transferred to the other guide block, i.e., as one guide block is pivoted along its arcuate slot, the other guide block moves in mirror-image relation thereto. Numerous mechanical or electrical means may be employed to interconnect the guide blocks so that they are always in bilateral symmetry with respect to one another on opposite sides of the central slot formed in the flat plate. When this second embodiment is employed, the central slot may be eliminated as well as the respective parts of said first, second, and third pivot pins that extend below the plane of the tool to engage said central slot for tool alignment purposes because the tool need not be otherwise aligned when the instantaneous position of one guide block is communicated to and reflected in the instantaneous position of the other guide block, as will become more clear as this description proceeds.

Note in both embodiments that the steps of marking the boards, pipes, or other items to be cut with a pencil, and of cutting along said pencil line, are eliminated. Note further that the craftsman is never required to read an angle from the measuring tool and to set the metering saw to such angle. Instead, an angle is measured, stored in the novel tool, and transferred directly to the guide blocks. This eliminates all of the sources of error found in the earlier devices, as aforesaid.

It will thus be seen that the primary object of this invention is to facilitate the making of miter cuts by providing a novel tool and a novel saw that work together to eliminate the need to transfer a measurement to a workpiece and to cut along a line.

Another object is to provide a method for making miter cuts that does not include reading angle settings from a measuring device and transferring said settings to a mitering saw.

In more positive terms, the primary object is to provide a method for making mitering cuts where a directly measured angle is directly transferred to a mitering saw so that the resulting cut will be as accurate as possible.

These and many other objects, features, and advantages of the invention will become apparent as this description proceeds.

The invention accordingly comprises the features of construction, arrangement of parts, and combination of elements that will be exemplified in the following detailed description, and the scope of the invention will be indicated in the claims.

BRIEF DESCRIPTION OF THE DRAWINGS

For a fuller understanding of the nature and objects of the invention, reference should be made to the following detailed description, taken in connection with the drawings in which.

DETAILED DESCRIPTION OF THE PREFERRED EMBODIMENT

Figure 1:
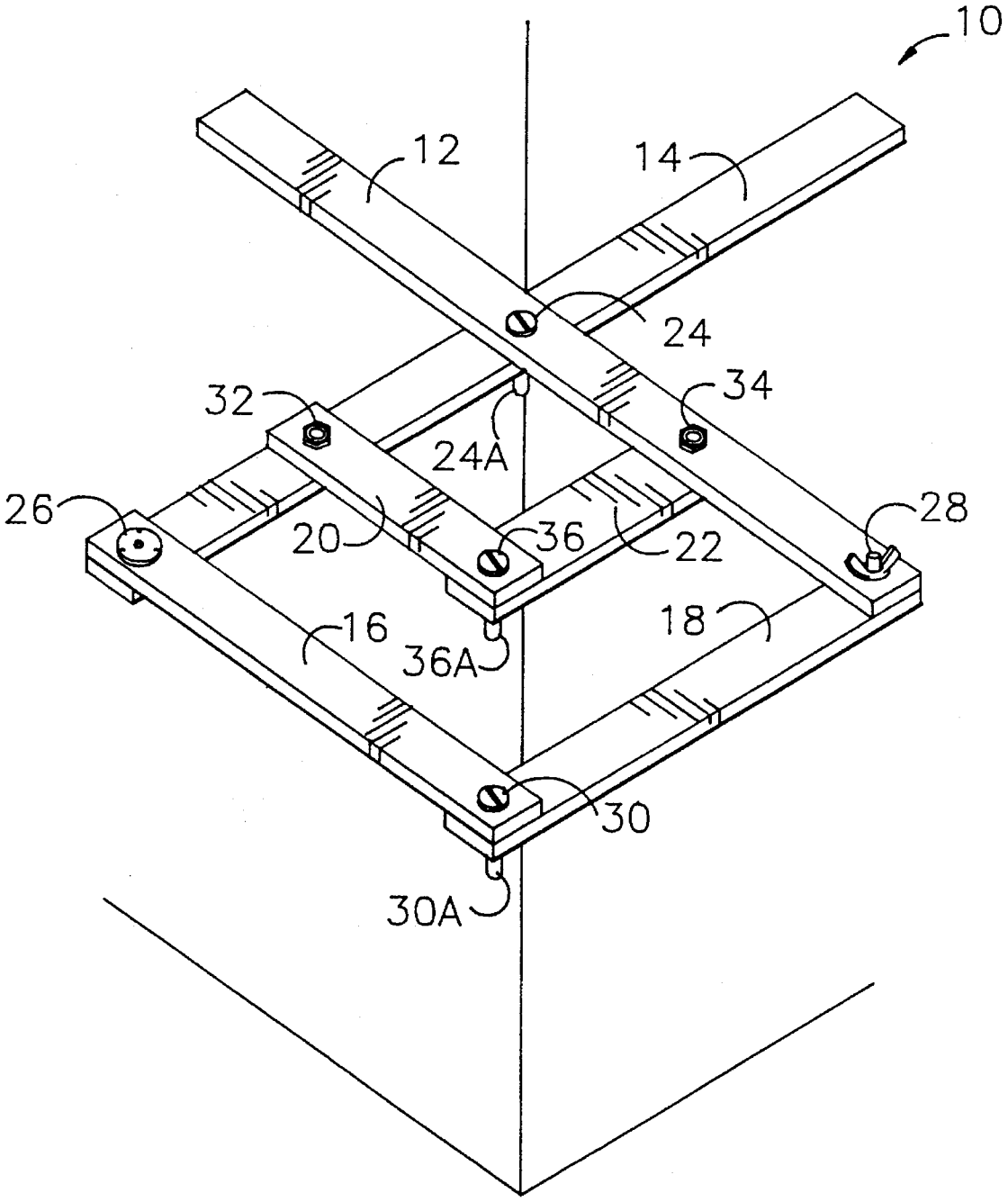
FIG. 1 is a perspective view of a first embodiment of the novel tool being used to measure an exterior angle.

Referring now to FIG. 1, it will there be seen that an illustrative embodiment of the novel parallelogram tool is denoted as a whole by the reference numeral 10.

Tool 10 includes first elongate link member 12, second elongate link member 14, third intermediate length link member 16, fourth intermediate link member 18, fifth truncate link member 20, and sixth truncate link member 22. The first and second link members 12 and 14 are pivotally interconnected to one another by pivot means 24, about mid-length thereof; note that pivot means 24 extends below the plane of the tool as indicated by the reference numeral 24A. The respective proximal ends of the third and fourth link members 16 and 18 are pivotally secured to the respective distal free ends of link members 14 and 12 by pivot means 26 and 28, and the distal free ends of said third and fourth link members are pivotally secured to one another by pivot means 30. Similarly, the respective proximal ends of the fifth and sixth link members 20 and 22 are pivotally secured to the second and first link members 14 and 12, respectively, at pivot means 32, 34, and the distal free ends thereof are pivotally connected to one another at pivot means 36. In this manner, the first, third, and fifth link members 12, 16, and 20 remain in parallel relation to one another throughout the full range of movement of tool 10, as do the second, fourth, and sixth link members 14, 18, and 22, respectively. The pivot means 30 and 36, like pivot means 24, each extend below the plane of tool 10 as indicated by the reference numerals 30A, 36A, respectively.

When an exterior angle has been measured as shown in FIG. 1, the tool is locked into position by tightening the wing nut that forms a part of pivot means 28. Once that wing nut is tightened, the tool may be separated from the exterior angle and moved to the novel miter saw.

Figure 2:
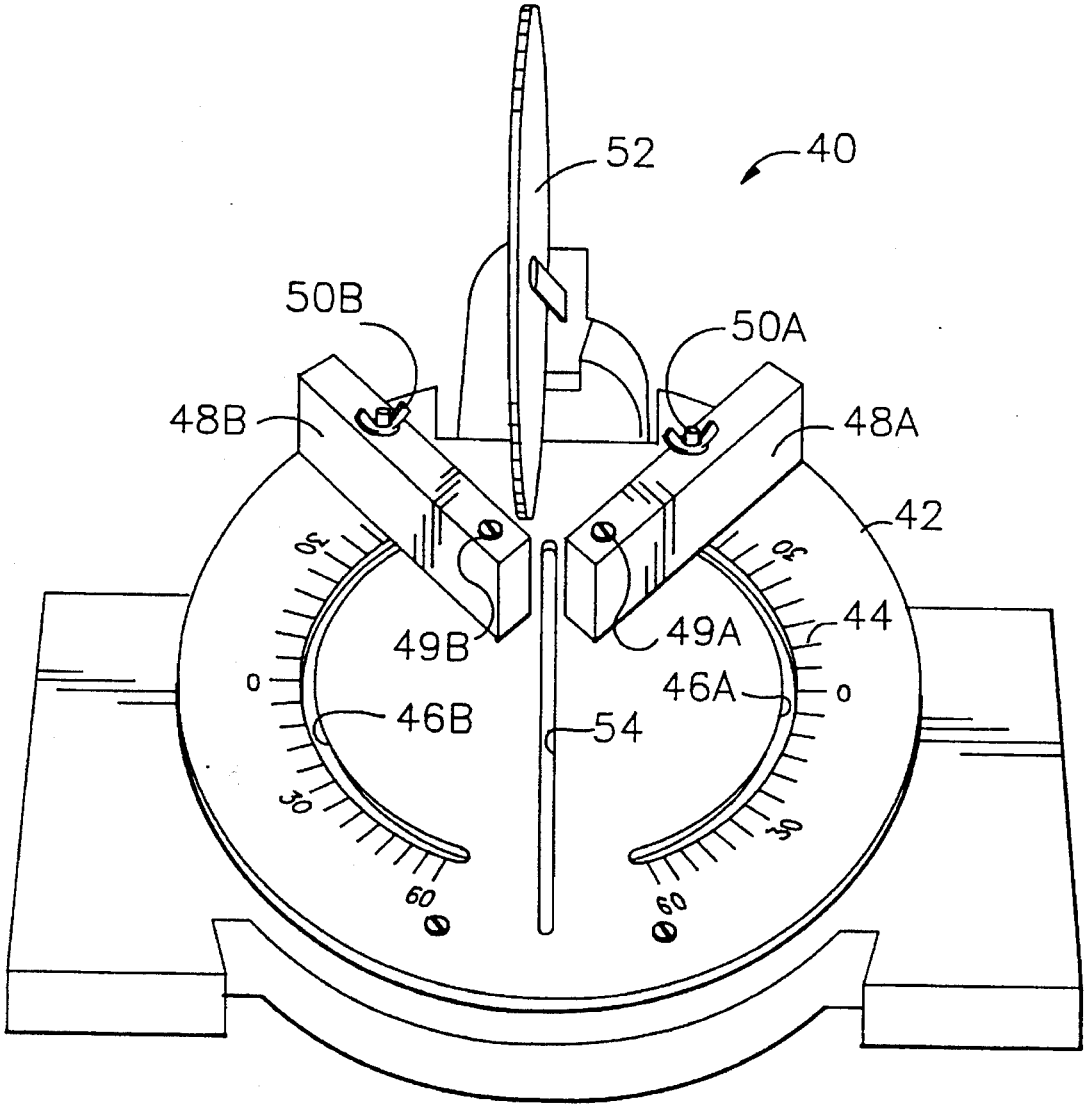
FIG. 2 is a perspective view of the novel miter saw, showing the guide blocks.

The novel saw is denoted 40 as a whole in FIG. 2. It includes a flat plate 42 having angular indicia 44 formed therein. A pair of arcuate slots 46A, 46B are formed in flat plate 42 along the extent of said indicia 44. Guide blocks 48A, 48B are positionable at a wide range of angles atop flat plate 42 by being pivotal about their respective pivot pins 49A, 49B, said pivot pins being at the radially innermost ends of said guide blocks. An elongate bolt extends through each of the guide blocks near the radially outermost end thereof and through each slot 46A, 46B as well so that as each of said bolts is tightened by tightening wing nuts 50A, 50B, its associated guide block is locked into position. The uppermost end of each bolt is depicted between the wings of its associated wing nut.

FIG. 2 also depicts saw blade 52 and the straight, diametrically extending central slot 54 formed in flat plate 42 that receives the saw blade and at least one of the pivot means 24A, 30A, or 36A when a miter cut is being made. The rotatably mounted saw blade 52 is movable in a vertical plane about pivot point 53 (FIGS. 7 and 8) in the well-known way. Note that the arcuate slots 46A, 46B exhibit bilateral symmetry with respect to said central slot 54.

Figure 3:
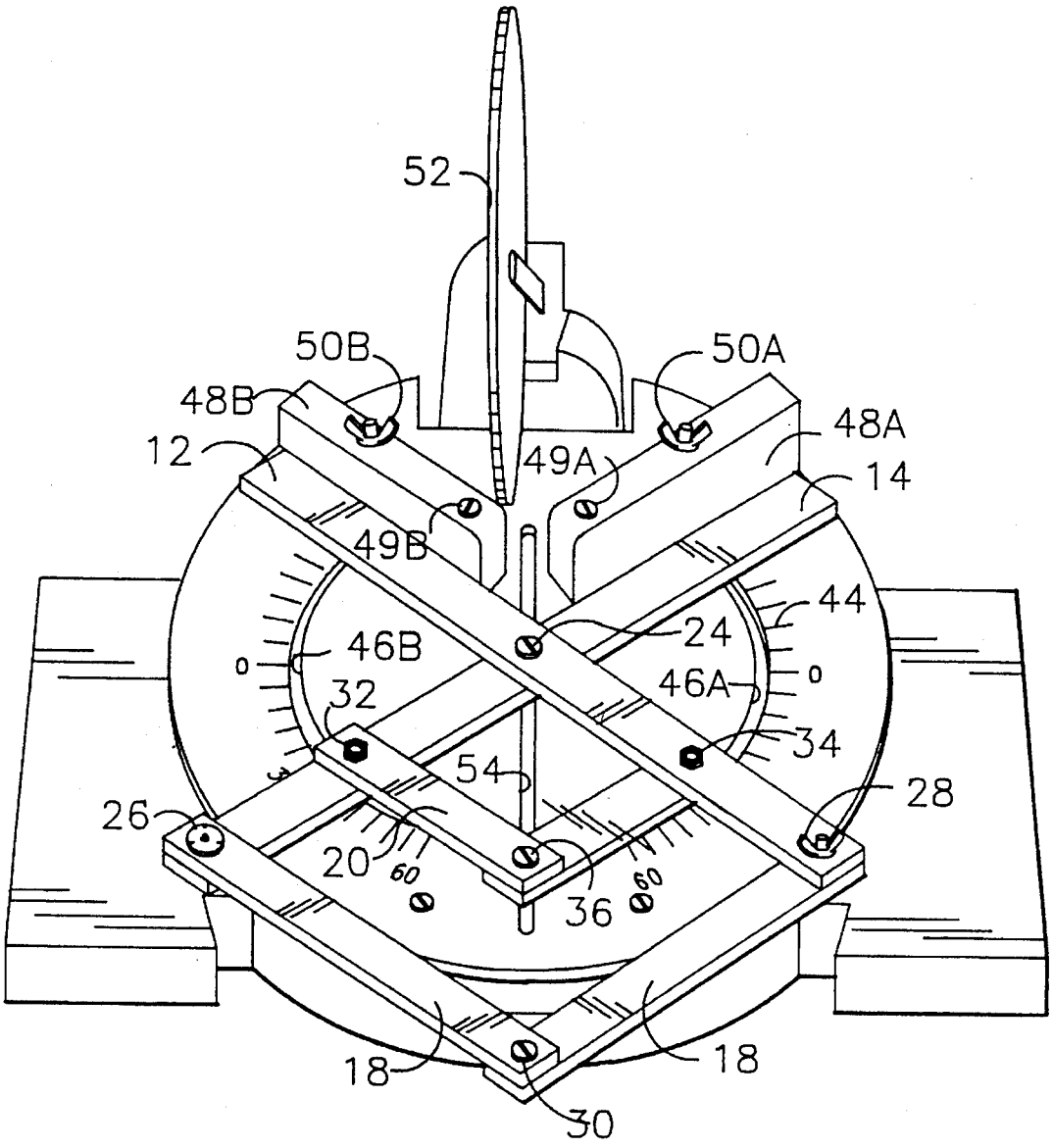
FIG. 3 is a perspective view showing how the measurement taken in FIG. 1 is transferred directly to the novel saw.

A measurement of an exterior angle such as that made in FIG. 1 is transferred to the saw 40 in the manner depicted in FIG. 3. Wing nuts 50A, 50B are loosened so that guide blocks 48A and 48B are free to pivot about their respective pivot pins 49A, 49B as the bolts held by wing nuts 50A, 50B slide along the extent of their associated arcuate slots 46A, 46B, and the rigid tool 10 is brought into overlying relation to flat plate 42 with at least one of the pivot means 24A or 36A extending into central slot 54 (both of said pivot means extend into said slot in the example of FIG. 3). The guide blocks 48A, 48B are then brought into abutting registration with the respective inner surfaces of link members 12 and 14 as depicted, and wing nuts 50A, 50B are tightened to maintain said guide blocks in said position. Tool 10 is then removed, and a board or other workpiece is placed into abutting relation to each guide block, and a miter cut is made in the well known way. Note that the positioning of the pivot means 24A or 36A into central slot 54 in this example aligns the tool so that the measured angle is accurately transferred to the guide blocks 48A, 48B.

Figure 4:
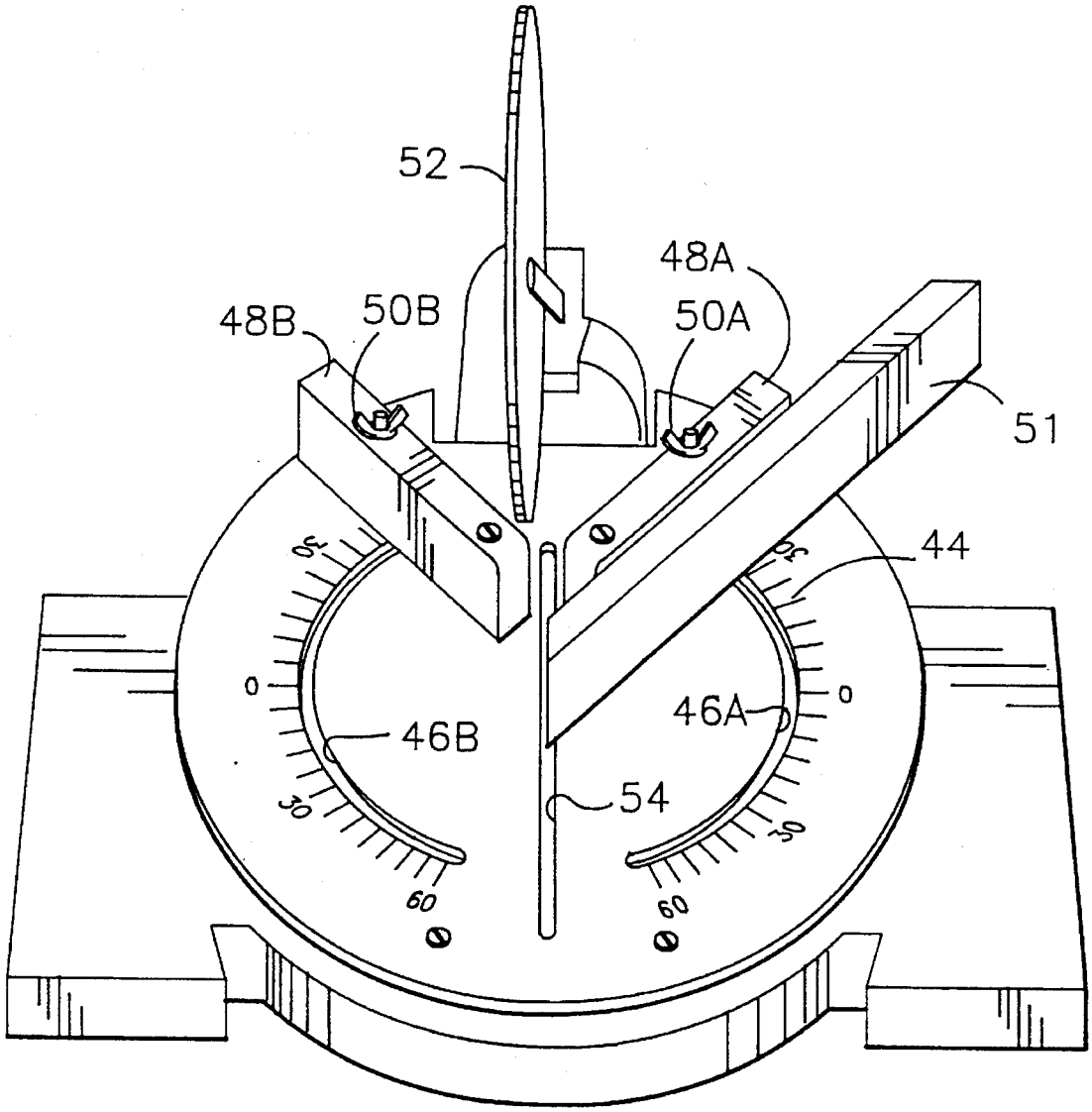
FIG. 4 is a perspective view showing how a board or other workpiece is cut after the novel tool has been used to set the proper setting for the guide blocks.

FIG. 4 shows just one board 51, but it should be understood that a second board is cut in the same way by abutting another board against guide block 48B.

Figure 5:
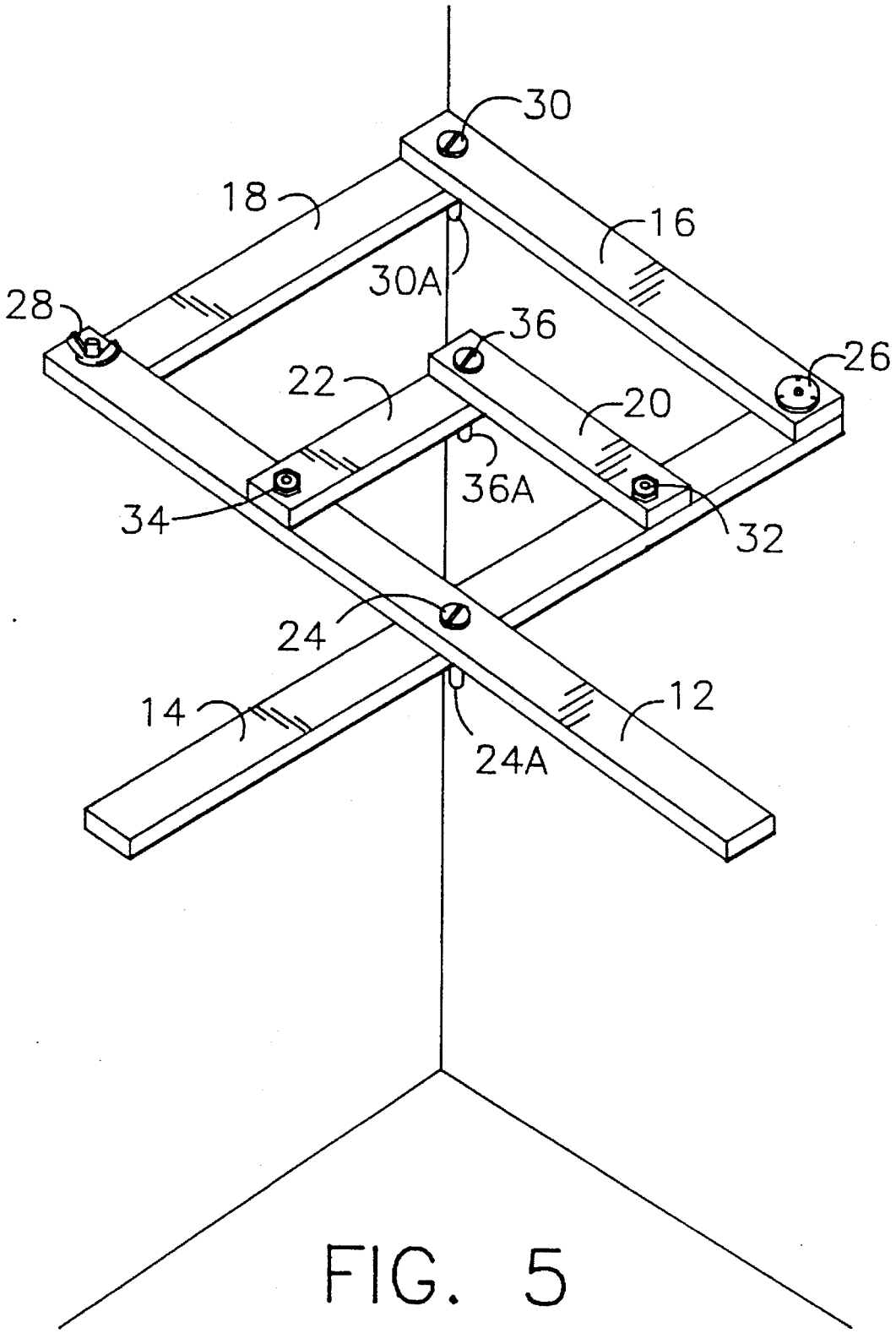
FIG. 5 is a perspective view of the novel tool being used to measure an interior angle.
Figure 6:
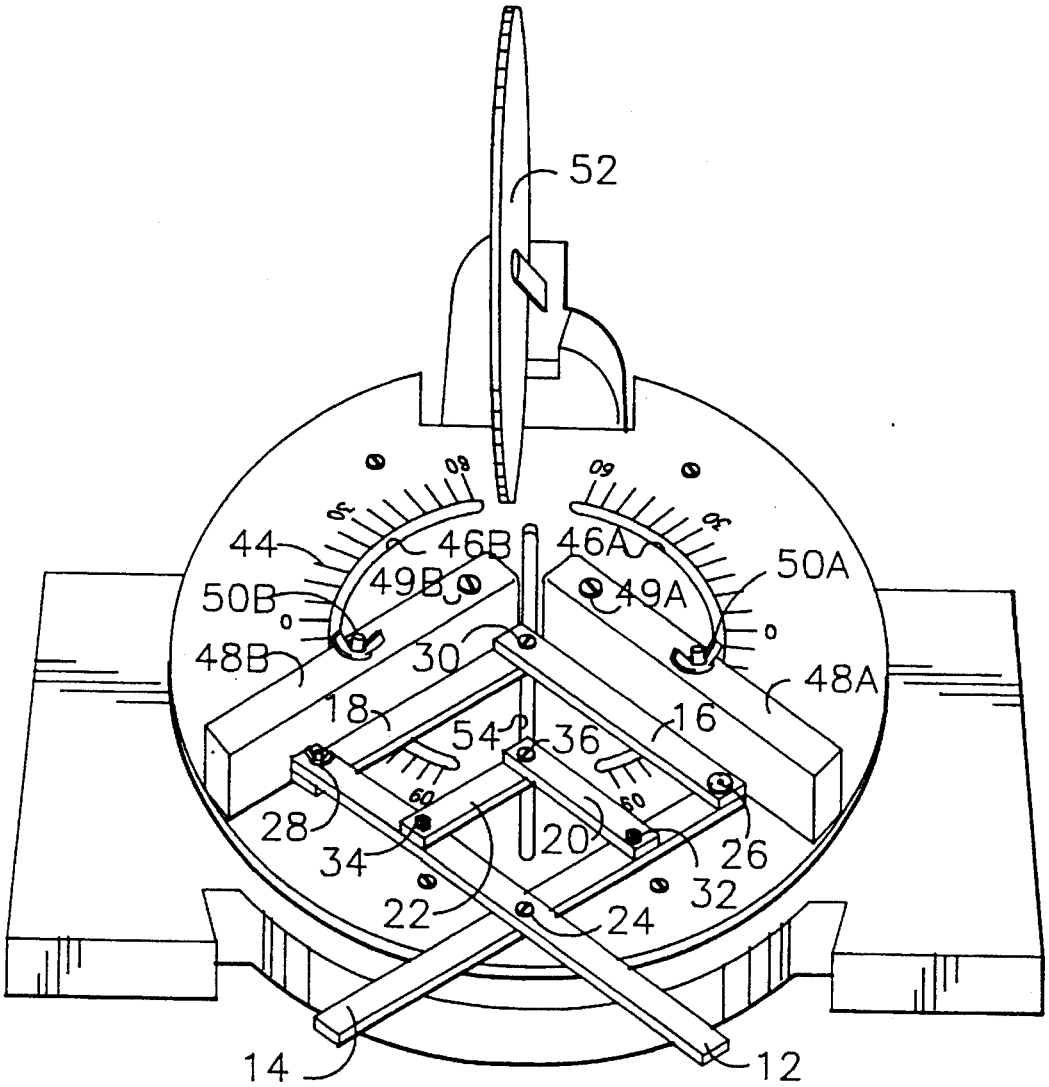
FIG. 6 is a perspective view showing how the measurement taken in FIG. 5 is transferred directly to the novel saw.

It is a simple manner to rotate tool 10 into the position shown in FIG. 5 to take the measurement of an interior angle. The transfer of said measurement, after wing nut 28 has been tightened, to saw 40 is depicted in FIG. 6. Wing nuts 50A, 50B are loosened, and guide blocks 48A, 48B are pivoted about pivot pins 49A, 49B into abutting relation to the exterior edges of link members 16, 18 as shown. Wing nuts 50A, 50B are then tightened and the tool is removed so that the items to be mitered may be placed into abutting relation to said guide blocks.

Figure 7:
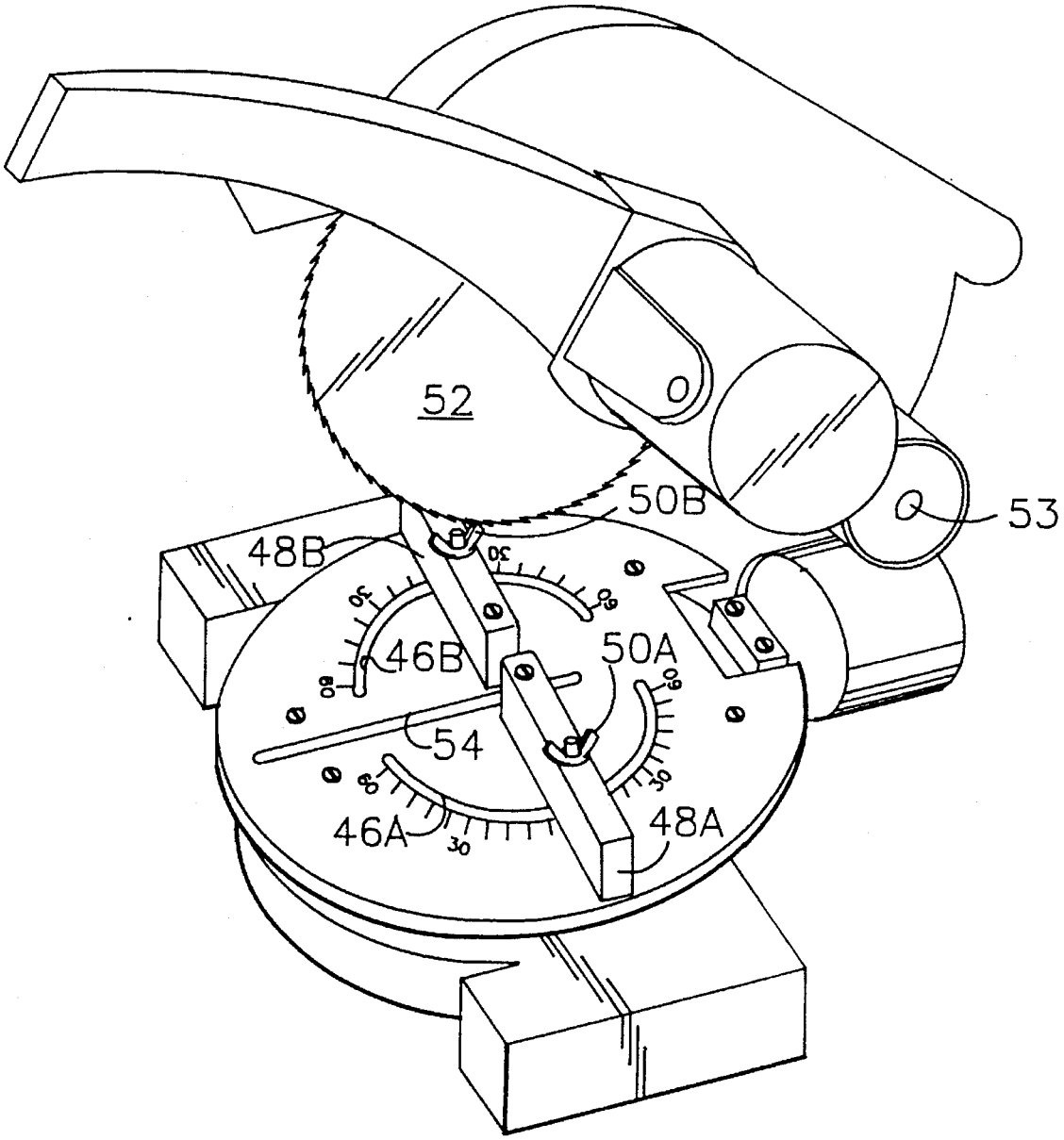
FIG. 7 is a perspective view of the novel saw.

FIG. 7 shows that the novel tool can also be used to cut boards, pipes, or the like that abut one another at a square angle, i.e., where the angle of the cut is ninety degrees.

Figure 8:
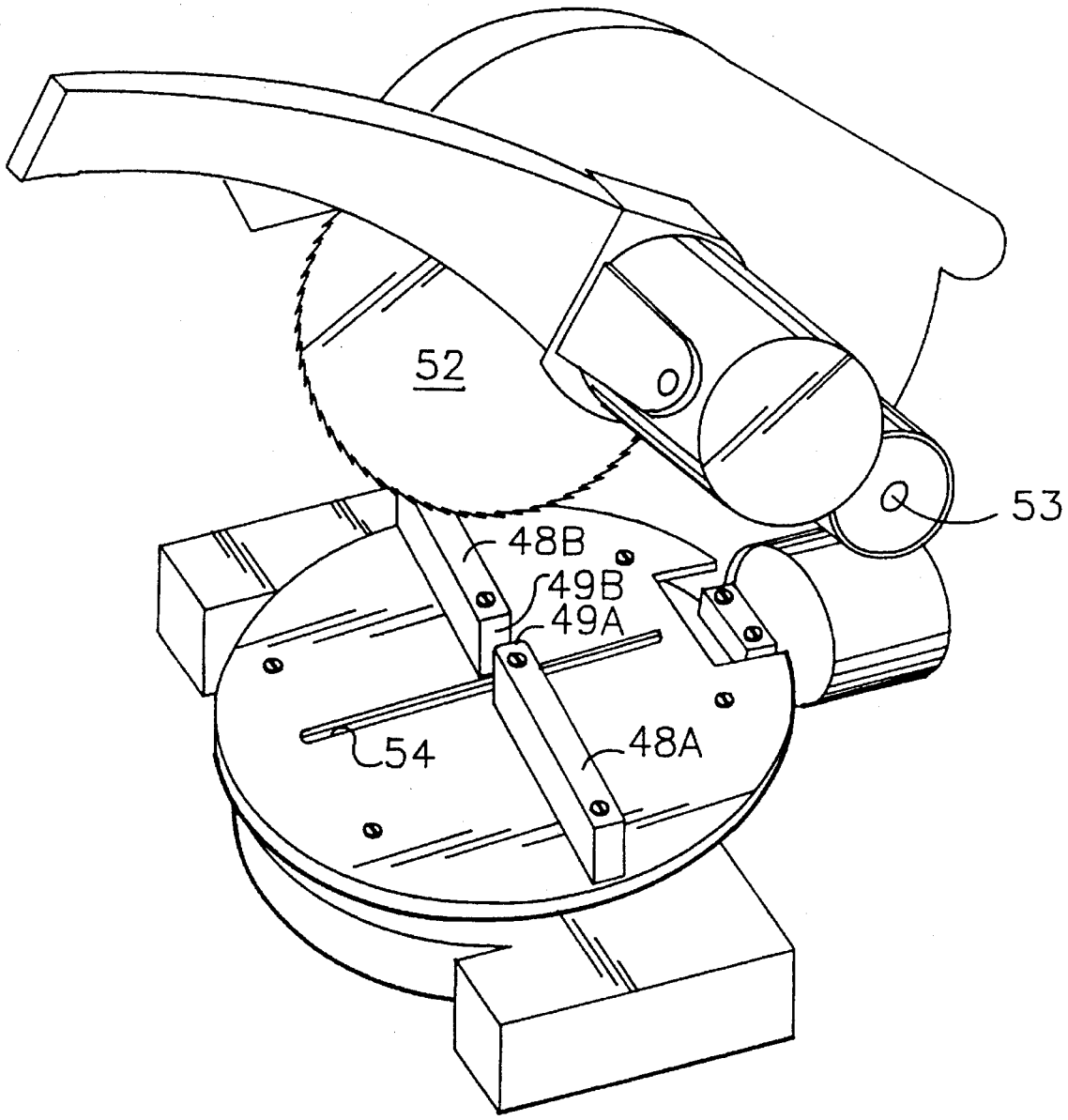
PRIOR ART FIG. 8
FIG. 8 is a perspective view of a prior art miter saw.

FIG. 8 shows a prior art miter saw where the arcuate slots are eliminated so that the guide blocks are permanently set for ninety degree cuts. Since the position of the guide blocks is not adjustable in this embodiment, wing nuts 50A, 50B are eliminated. Note that the guide blocks 48A, 48B are in longitudinal alignment with one another, and that the flat ends 49A, 49B thereof are formed squarely, i.e., at ninety degree angles, and that said square ends are closely spaced relative to one another on opposite sides of the central slot 54.

Figure 9:
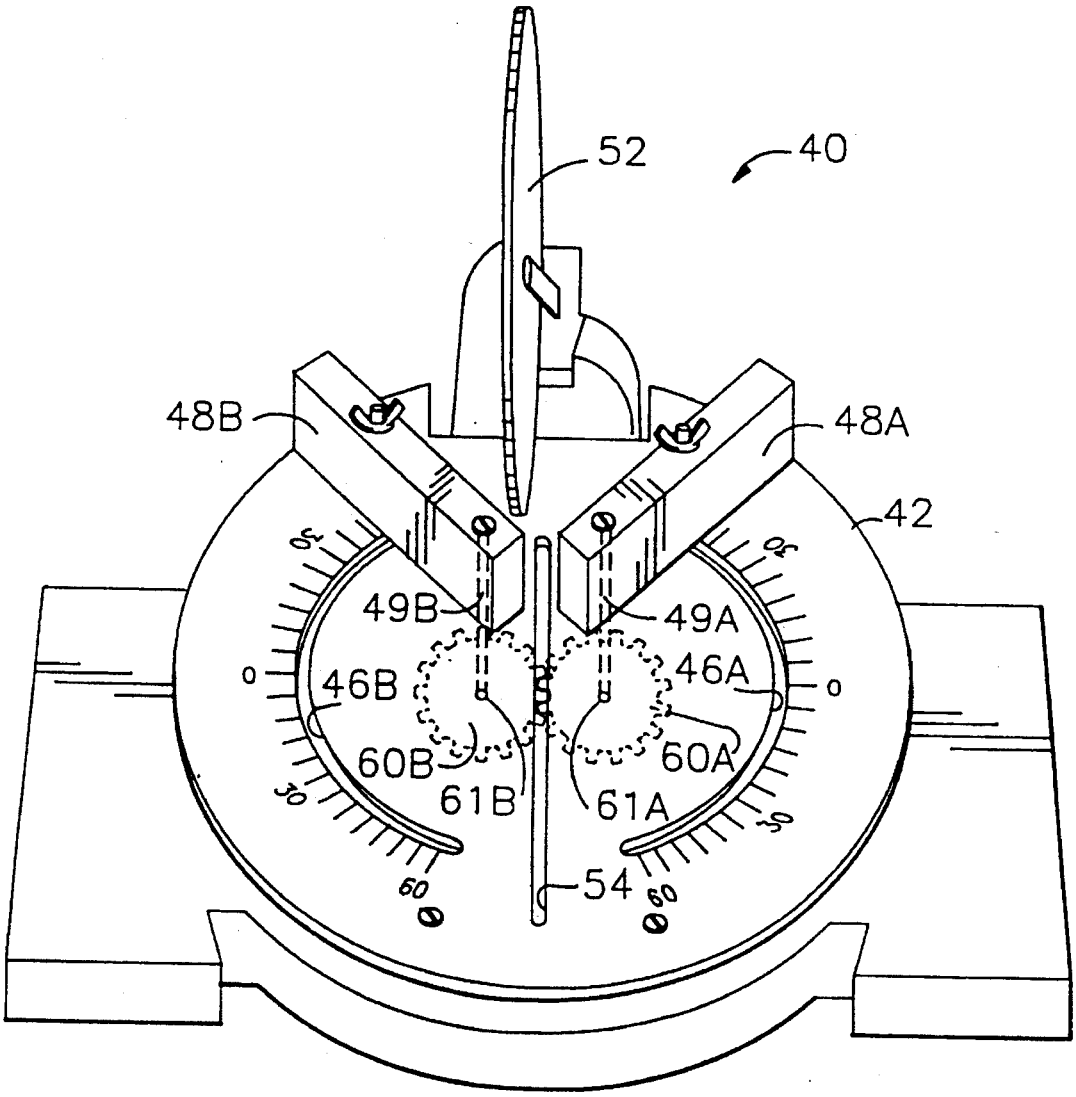
FIG. 9 is a perspective view of a second embodiment.

A second embodiment of the invention is shown in FIG. 9. In this embodiment, pivot means 24, 30, and 36 need not extend below the plane of tool 10 as at 24A, 30A, and 36A as aforesaid. A pair of gears 60A and 60B having intermeshing teeth are rotatably mounted about their respective axes of rotation 61A, 61B as shown. Thus, rotation of one gear effects simultaneous and opposite rotation of the other gear. Pivot pins 49A, 49B are secured for conjoint rotation to their associated gears 61A, 61B, respectively, so that rotation of guide block 48A is instantaneously communicated to guide block 48B. Thus, each guide block will always be positioned at the same angle as its counterpart, and the need to align tool 10 by inserting at least one of the pivot means 24A, 30A, or 36A through central slot 54 is eliminated. Note that gears 60A, 60B are positioned on the underside of flat plate 42 so as not to interfere with tool 10 when placed atop said flat plate 42. Numerous other mechanical and electrical or electronic means are available for interconnecting the guide blocks so that the position of one is instantaneously communicated to the other, and all of said means are within the scope of this invention.

This invention is clearly new and useful. Moreover, it was not obvious to those of ordinary skill in this art at the time it was made.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A tool for measuring exterior and interior angles, comprising:

a first elongate link member;

a second elongate link member;

a first pivot means for pivotally interconnecting said first and second link members to one another about mid-length thereof;

a third intermediate length link member having a proximal end pivotally connected to a distal end of said second elongate link member;

a fourth intermediate link member having a proximal end pivotally interconnected to a distal end of said first elongate link member;

a second pivot means for pivotally interconnecting respective distal ends of said third and fourth intermediate link members to one another;

a fifth truncate link member having a proximal end pivotally connected to said second elongate link member about midway between said first pivot means and the pivotal connection between the distal end of said second elongate link member and the proximal end of said third intermediate length link member; and a sixth truncate link member having a proximal end pivotally connected to said first elongate link member about midway between said first pivot means and the pivotal connection between the distal end of said first elongate link member and the proximal end of said fourth intermediate length link member;

a third pivot means for pivotally interconnecting the respective distal free ends of said fifth and sixth truncate link members to one another;

said first, third, and fifth link members remaining in parallel relation to one another and said second, fourth, and sixth link members remaining in parallel relation to one another throughout the entire range of motion of said tool; and said first, second, and third pivot means extending below a plane defined by said tool;

where by an exterior angle defined by first and second converging exterior walls is measured by positioning said first and second elongate link members into abutting relation to said first and second converging exterior walls, respectively; and whereby an interior angle defined by first and second converging interior walls is measured by positioning said third and fourth intermediate link members into abutting relation to said first and second converging interior walls, respectively,

2. The tool of claim 1, further comprising means for locking said tool into a position when said tool has been used to measure an angle, said means for locking including a nut means disposed at a preselected pivot point of said tool.

3. A combination angle measuring tool and miter saw, comprising:

a first elongate link member;

said first elongate link member providing a first exterior angle measuring arm of said angle measuring tool:

a second elongate link member;

said second elongate link member providing a second exterior angle measuring arm of said angle measuring tool;

a first pivot means for pivotally interconnecting said first and second elongate link members to one another about mid-length thereof;

said first pivot means extending below a plane of said tool;

a third intermediate length link member having a proximal end pivotally connected to a distal end of said second elongate link member;

said third intermediate length link member providing a first interior angle measuring arm of said angle measuring tool;

a fourth intermediate link member having a proximal end pivotally interconnected to a distal end of said first elongate link member;

said fourth intermediate length link member providing a second interior angle measuring arm of said angle measuring tool;

a second pivot means for pivotally interconnecting the respective distal ends of said third and fourth intermediate link members to one another;

said second pivot means extending below the plane of said tool;

a fifth truncate link member having a proximal end pivotally connected to said second elongate link member about midway between said first pivot means and the pivotal connection between the distal end of said second elongate link member and the proximal end of said third intermediate length link member;

a sixth truncate link member having a proximal end pivotally connected to said first elongate link member about midway between said first pivot means and the pivotal connection between the distal end of said first elongate link member and the proximal end of said fourth intermediate length link member;

a third pivot means for pivotally interconnecting the respective distal ends of said fifth and sixth truncate link members;

said third pivot means extending below the plane of said tool;

said first, third, and fifth link members remaining in parallel relation to one another and said second, fourth, and sixth link members remaining in parallel relation to one another throughout the entire range of motion of said tool;

means for locking said tool into a position when said tool has been used to measure an angle, said means for locking including a nut means disposed at a preselected pivot point of said tool;

a flat plate for supporting a workpiece;

a base for Supporting said flat plate;

a rotatably mounted miter saw blade mounted to said base;

a diametrically-extending, straight slot formed in said flat plate, centrally thereof, for receiving said miter saw blade;

a pair of arcuate slots formed in said flat plate, said arcuate slots being disposed in opposing, bisymmetrical relation to one another on opposite sides of said straight slot;

a pair of guide blocks mounted for pivotal movement relative to said flat plate, each guide block of said pair of guide blocks being constrained to pivot along the extent of its associated arcuate slot;

locking means for locking each of said guide blocks into a fixed position relative to its associated arcuate slot; and alignment means for aligning the tool relative to said flat plate prior to adjustment of said guide blocks;

said alignment means being said first, second, and third pivot means that extend below the plane of said tool;

at least one of said first, second, or third pivot means being positioned within said straight slot when said tool is placed atop said flat plate to align said tool and said flat plate;

whereby said tool having an angular measurement stored therein is placed atop said workpiece with each angle-measuring arm of said tool disposed in abutting relation to an associated guide block and with at least one of said first, second, and third pivot means being disposed in said straight slot;

whereby each of said guide blocks is locked into position before said tool is removed; and whereby upon removal of said tool, workpieces to have a miter cut formed therein are positioned in abutting relation to said guide blocks and a miter cut is made therein by said miter saw blade.

4. A combination angle measuring tool and miter saw comprising:

a plurality of link members disposed in a parallelogram configuration;

said plurality of link members collectively disposed in a common plane;

a plurality of pivot means for pivotally interconnecting said plurality of link members to one another in said parallelogram configuration;

at least one of said pivot means extending below said plane defined by said tool;

a first end of said angle measuring tool including a pair of elongate link members that abut converging exterior sidewalls of a structure to measure an angle therebetween:

a second end of said angle measuring tool including a pair of intermediate length link members that abut converging interior sidewalls of a structure to measure an angle therebetween:

a pair of truncate link members disposed between said first end of said parallelogram and said second end of said parallelogram:

a miter saw having a flat plate for supporting a workpiece;

a straight, diametrically extending slot formed in said flat plate;

said angle measuring tool being disposed in overlying relation to said flat plate when said angle measuring tool is used to transfer a measured angle from a sidewall to said miter saw;

said at least one pivot means extending into said slot when said angle measuring tool is disposed into overlying relation to said flat plate; and a locking means for locking said plurality of link members into position when an angle has been measured so that the plurality of link members remains in said position when said angle measuring tool is transferred from a sidewall to said flat plate of said miter saw.

* * * * *